US007370569B2

(12) United States Patent
Schmidt et al.

(10) Patent No.: US 7,370,569 B2
(45) Date of Patent: May 13, 2008

(54) HYDRAULIC DRIVE

(75) Inventors: Stefan Schmidt, Lohr am Main (DE); Rolf Heidenfelder, Hafenlohr (DE)

(73) Assignee: Bosch Rexroth AG, Stuttgart (DE)

( * ) Notice: Subject to any disclaimer, the term of this patent is extended or adjusted under 35 U.S.C. 154(b) by 241 days.

(21) Appl. No.: 10/557,023

(22) PCT Filed: May 14, 2004

(86) PCT No.: PCT/DE2004/001014

§ 371 (c)(1),
(2), (4) Date: Nov. 16, 2005

(87) PCT Pub. No.: WO2004/103692

PCT Pub. Date: Dec. 2, 2004

(65) Prior Publication Data

US 2007/0012171 A1 Jan. 18, 2007

(30) Foreign Application Priority Data

May 16, 2003 (DE) ..... 103 22 169
Jan. 30, 2004 (DE) ..... 10 2004 005 020

(51) Int. Cl.
*F15B 13/04* (2006.01)
*F15B 15/17* (2006.01)

(52) U.S. Cl. ..... 91/29; 91/417 R; 60/486

(58) Field of Classification Search ..... 91/6, 91/29, 47, 321, 417 R; 60/429, 430, 486
See application file for complete search history.

(56) References Cited

U.S. PATENT DOCUMENTS 4,825,745 A 5/1989 Kuttruf
4,873,912 A 10/1989 Schulze
5,042,362 A 8/1991 Schulze

FOREIGN PATENT DOCUMENTS

DE 32 19 730 A1 12/1983
DE 37 20 266 C2 12/1988

*Primary Examiner*—Michael Leslie
(74) *Attorney, Agent, or Firm*—Oliff & Berridge, PLC

(57) ABSTRACT

What is disclosed is a hydraulic drive mechanism for a blanking or forming machine comprising a working cylinder having several pressure chambers, the piston of which acts directly or indirectly on a workpiece to be processed, wherein at least one pressure chamber of the working cylinder for retracting and extending the piston is adapted to be subjected to a tank pressure or a supply pressure via a continuously adjustable valve, and comprising a valve assembly arranged upstream of the continuously adjustable valve, whereby an inlet port of the continuously adjustable valve may be subjected to a higher or lower supply pressure, wherein the valve assembly comprises a switching valve adapted to be switched over between a basic position and a switching position in dependence on the load pressure at the working cylinder in order to tap the supply pressure from a low-pressure source or from a high-pressure source.

16 Claims, 2 Drawing Sheets

HYDRAULIC DRIVE

The invention concerns a hydraulic drive mechanism for a blanking or forming machine in accordance with the preamble of claim 1.

The like hydraulic drive mechanisms for blanking or forming machines, in particular fast-moving nibbling machines, include a working cylinder having the form of a differential cylinder whereby a blanking tool is operated. A circuit diagram of such a known hydraulic drive mechanism which is, however, not described in literature, is represented in FIG. 1.

A working cylinder 2 is subdivided by a piston 4 into a piston bottom-side cylinder chamber 6 and a piston rod-side annular chamber 8. The cylinder chamber 6 is supplied with pressure medium via a continuously adjustable valve 10. An inlet port E of the continuously adjustable valve 10 is connected with a valve assembly 12. The valve assembly 12 hat a releasable non-return valve 14 and a non-return valve 16 arranged in parallel and blocking in the opposite direction. The releasable non-return valve 14 may be released by a predetermined load pressure in the cylinder chamber 6. It is connected with a high-pressure reservoir HD via a supply line 28. The non-return valve 16 is connected via a supply line 32 with a low-pressure reservoir ND. As is moreover visible in FIG. 1, the annular chamber 8 is permanently connected with the low-pressure reservoir ND.

For rapidly extending the piston 4, the continuously adjustable valve 10 and the valve assembly 12 are in the represented basic positions. The cylinder chamber 6 is subjected to low pressure, so that the piston 4 is extended rapidly owing to its differential area. When the piston 4 impacts on a workpiece to be punched, the pressure in the cylinder chamber 6 rises. This load pressure is reported to the releasable non-return valve 14. Starting from a particular load it acts as a switchover pressure, and the non-return valve 14 is unlocked. Accordingly the high-pressure reservoir HD is added on. The high pressure is conducted to the inlet port E and thus into the cylinder chamber 6, so that a maximum punching force may be applied. The high pressure is also present at the non-return valve 16, so that the latter closes, and the pressure medium connection to the low-pressure reservoir ND is closed. Following punching, the load pressure in the cylinder chamber 6 drops, so that as a result the releasable non-return valve 14 again assumes its basic position, and the low-pressure reservoir ND is added on.

It is a drawback in this known solution that the non-return valve in the low-pressure line only closes through a time delay of 2 ms to 5 ms, so that the pressure medium subjected to high pressure flows off via the non-return valve to the low-pressure reservoir. At stroke times of about 10 ms to 20 ms for extending the working cylinder, there consequently results a considerable loss of time and energy.

It is another drawback of the known solution that adding on the high-pressure reservoir and deactivating the low-pressure reservoir cannot be enforced without load pressure. In some operating modes, e.g., in punching and forming in the vicinity of the switchover pressure, however, it is necessary that the working cylinder be supplied with a permanent high load pressure. Accordingly the represented drive unit is not unconditionally suited for punching and forming.

Another drive unit is disclosed in DE 37 20 266 C2. The drive unit includes a working cylinder with a piston separating an annular chamber from a cylinder chamber. The annular chamber acts in the retracting direction, and the cylinder chamber acts on the piston in the extending direction. By way of a valve assembly adjustable by means of a motor drive and comprising two control spools of two control valves that are in mechanical operational engagement with each other, the cylinder chamber may be subjected to high pressure, low pressure, or a tank pressure. The annular chamber is permanently subjected to low pressure.

The control spools are in contact with each other by their end faces and biased into their basic positions by means of a spring. In order to displace the control spool, a cam disc acting on one of the control spools is driven by an electromotor such that depending on the rotation of the cam disc, the control spools are taken from their basic positions into control positions. For rapid extension of the piston, the cylinder chamber is subjected to low pressure. Owing to the differential area of the piston, the latter extends until it impacts on a workpiece to be processed. In order to apply a high punching force, the cylinder chamber is subjected to high pressure. For rapid retraction of the piston, the cylinder chamber is relieved of pressure towards the tank, so that owing to the low pressure acting in the annular chamber, the piston is moved back into its starting position.

It is a drawback in this solution that the valve assembly including the two mutually contacting control spools and the motor drive have a complex design in terms of device technology.

It is an object of the present invention to provide a hydraulic drive mechanism for a blanking or forming machine wherein no substantial losses of time and energy occur during pressure switching.

This object is attained through a hydraulic drive mechanism for a blanking or forming machine having the features in accordance with claim 1.

The drive unit in accordance with the invention comprises a working cylinder, the piston of which directly or indirectly acts on a workpiece to be processed. At least one pressure chamber of the working cylinder is adapted to be subjected to a tank pressure or a supply pressure for retracting and extending the piston via a continuously adjustable valve. Moreover a valve assembly is provided which is arranged upstream of the continuously adjustable valve, whereby the one inlet port of the continuously adjustable valve may be subjected to a higher or lower supply pressure. In accordance with the invention, the valve assembly comprises a switching valve which may be switched between a basic position and a switching position in dependence on the load pressure at the working cylinder in order to tap the supply pressure from a low-pressure source or from a high-pressure source.

Owing to the mechanical connection of the control edges of the switching valve, a time loss between adding on the high pressure and deactivating the low pressure is reduced substantially in comparison with the solution including the separate non-return valves. Therefore, a pressure medium subjected to high pressure can not flow off into the low-pressure reservoir, and no energy loss occurs. Accordingly, pressure buildup at the continuously adjustable valve takes place more rapidly. In addition, the valve assembly in accordance with the invention may be realized simply and cost-efficiently.

In a preferred embodiment, the working cylinder comprises a cylinder chamber and an annular chamber. The pressure in the cylinder chamber acts on the piston in the extending direction, and the pressure in the annular chamber acts in the retracting direction. Furthermore the pressure in the cylinder chamber acts on a large control surface of the switching valve and constitutes, starting from a particular load pressure, the switchover pressure for switching the switching valve into its switching position, with the pressure in the annular chamber acting on a small control surface of the switching valve in the opposite direction.

In a preferred embodiment a pilot valve is provided, whereby the small control surface of the switching valve acting in the direction towards the basic position may be relieved of load, so that in the presence of a reduced load pressure in the cylinder chamber, the switching valve may be switched over and high pressure may be conducted to the cylinder chamber. Preferably the pilot valve is actuated electrically.

Fundamentally it is possible for the annular chamber to be permanently subjected to high pressure. In a preferred manner, however, the annular chamber is permanently connected to the low-pressure source, for the annular surface is then larger and capable of receiving higher loads as a stop means.

The working cylinder may have two or three pressure chambers.

Further advantageous embodiments of the invention are subject matter of further subclaims.

In the following, preferred embodiments of the invention shall be explained in more detail by referring to schematic representations, wherein:

FIG. 2 shows a strongly simplified circuit diagram of a drive mechanism 1 of a fast-moving nibbling machine. In the like nibbling machines the extension movement takes place within 10 ms to 20 ms.

Figure 1:
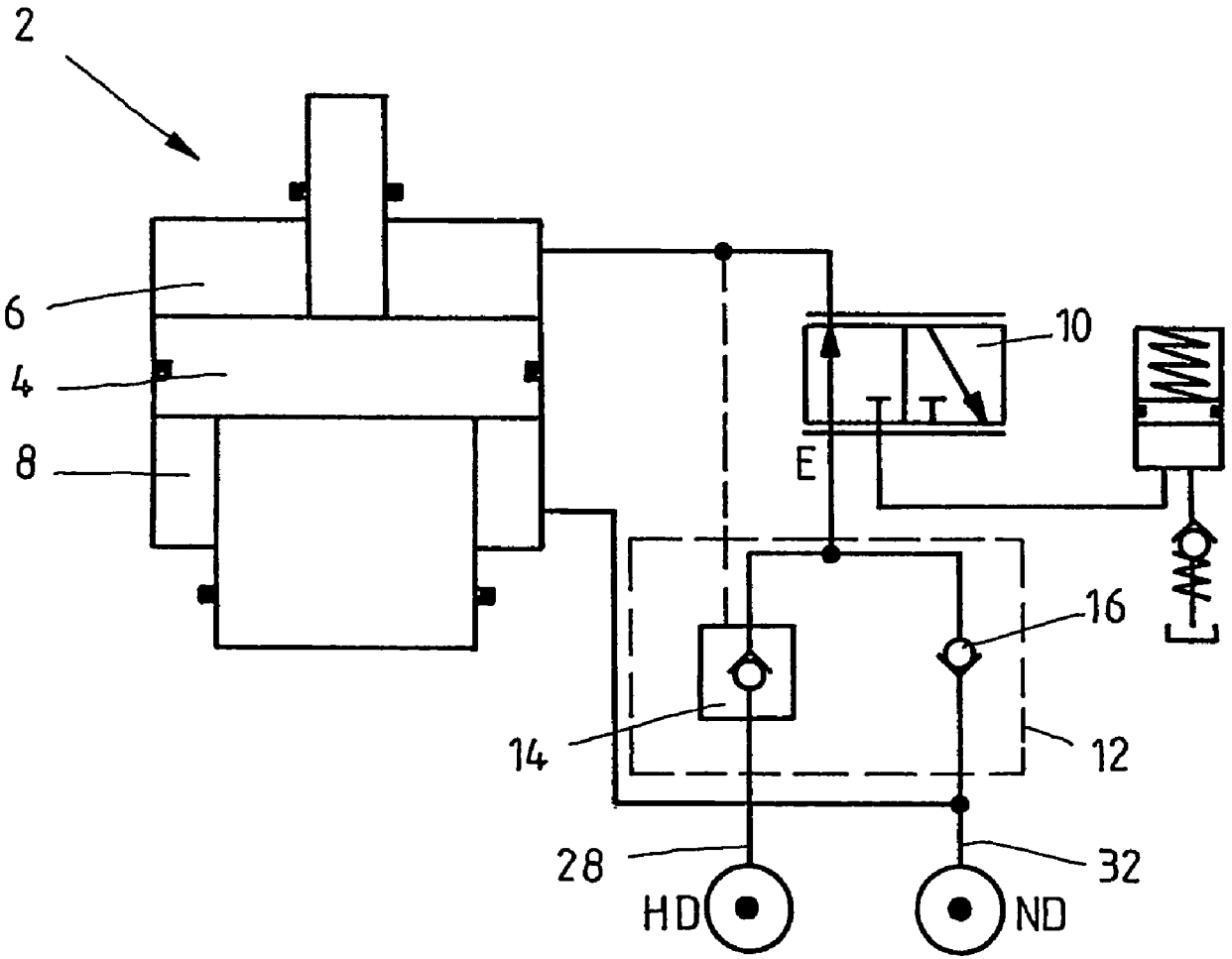
Related Art FIG.1
FIG. 1 is a circuit diagram of a known solution of a hydraulic drive mechanism for a nibbling machine.
Figure 2:
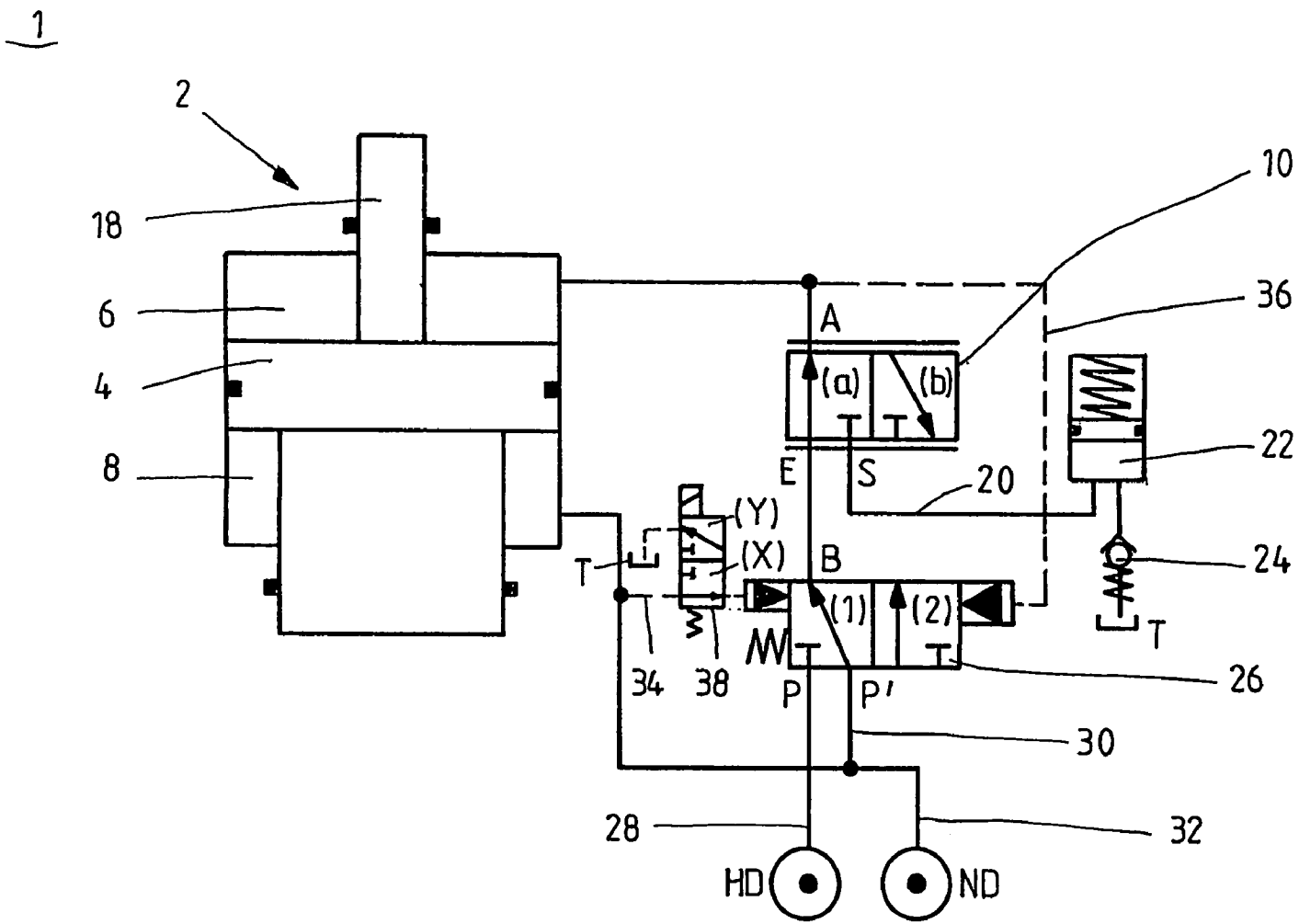
FIG. 2 is a circuit diagram of a preferred solution of a hydraulic drive mechanism for a nibbling machine in accordance with the invention.

The nibbling machine comprises a working cylinder 2 having, like in the above described known solution, a piston 4 separating a cylinder chamber 6 from an annular chamber 8 and indirectly or directly acting on a blanking tool. The piston 4 has a rear-side piston rod 18 extending from the piston bottom and penetrating the working cylinder 2 on the end-face side.

The cylinder chamber 6 is connected with a working port A of a continuously adjustable valve 10 which, in one of its control positions (b), opens a connection between the cylinder chamber 6 and a tank line 20 connected with a tank. In the tank line 20 a tank line attenuator 22 and a biasing valve 24 are arranged. Thanks to the tank line attenuator 22, pressure fluctuations in the tank line 20 are suppressed, and the tank line 20 is biased to a pressure equivalent to the spring of the biasing valve 22 by the biasing valve 24.

An inlet port P of the continuously adjustable valve 12 is connected with a working port B of a switching valve 26 that is connected with a pressure port P or a pressure port P' of the switching valve 26 depending on the switching position (1), (2) of the switching valve 26. The pressure port P is connected with a high-pressure reservoir HD via a supply line 28, and the pressure port P' is connected with a low-pressure reservoir ND via a branch line 30 and a portion of a supply line 32. The supply line 32 connects the low-pressure reservoir ND with the annular chamber 8.

The pressure in the annular chamber 8 is tapped via a control line 34 and an electrically operated pilot valve 38. In the basic position (x) of the pilot valve 38, the pressure is conducted to a small control surface of the switching valve 26 acting in the direction of the basic position (1) of the switching valve 26. In a control position (y) of the pilot valve 38, the connection towards the small control surface is blocked, and a connection of the small control surface towards the tank T is opened.

The pressure in the cylinder chamber 6 is tapped via a control line 36 and conducted to a large control surface of the switching valve 26 acting in the direction towards the switching position (2).

In order to initiate the blanking process, i.e., for a rapid advance, the switching valve 26 is in its represented basic position (1). The pilot valve 34 is in its basic position (x), and the pressure acting in the annular chamber 8 is conducted to the small control surface of the switching valve 26. In the same way, the continuously adjustable valve 10 is in its represented basic position (a). Thus the cylinder chamber 6 is subjected to low pressure. The annular chamber 8 is equally supplied with low pressure via the supply line 32, so that the piston 4 extends owing to its differential area, with pressure medium being displaced from the annular chamber 8 into the low-pressure reservoir ND.

When the piston 4 impacts on a workpiece to be blanked, the load pressure in the cylinder chamber 6 increases. When a particular load pressure level is exceeded, it acts as a switchover pressure and the switching valve 26 is taken against the force of a reset spring and a force corresponding to the pressure acting on the small control surface into its switching position (2) in which the working port B is connected with the pressure port P, so that high pressure acts on the piston bottom surface and the punching force applied by the working cylinder 2 is thus increased. Following blanking, the load pressure drops and the switching valve 26 again switches into its basic position (1) in which the pressure port P is blocked and the pressure port P' is opened, so that the working port B is again subjected to low pressure.

In order to retract the piston 4, i.e., for rapid retraction, the continuously adjustable valve 10 is taken into its control positions designated by (b), wherein the cylinder chamber 6 is connected with the tank T. Owing to the low pressure acting in the annular chamber 8, the piston 4 is pushed back into its starting position.

For punching, the pilot valve 38 may during the fast advance optionally be taken into its control position (y) in which the control line 34 is blocked, and the small control surface of the switching valve 26 towards the tank is relieved of pressure. Thus only the force of the reset spring acts against the load pressure present at the large control surface, so that the required switchover pressure is reduced correspondingly. The switching valve 26 is taken from its basic position (1) into its switching position (2) against the force of the reset spring, so that the pressure port P' is blocked, and the pressure port P is opened. Correspondingly, the cylinder chamber 6 is subjected to high pressure, so that the maximum working force is available even prior to buildup of the maximum load pressure.

The solution of the invention including a switching valve 26 arranged upstream of the continuously adjustable valve 10 may also be employed in other cylinder constructions, e.g., with three pressure chambers.

What is disclosed is a hydraulic drive mechanism for a blanking or forming machine comprising a working cylinder having several pressure chambers, the piston of which acts directly or indirectly on a workpiece to be processed, wherein at least one pressure chamber of the working cylinder for retracting and extending the piston is adapted to be subjected to a tank pressure or a supply pressure via a continuously adjustable valve, and comprising a valve assembly arranged upstream of the continuously adjustable valve, whereby an inlet port of the continuously adjustable valve may be subjected to a higher or lower supply pressure, wherein the valve assembly comprises a switching valve adapted to be switched over between a basic position and a switching position in dependence on the load pressure at the working cylinder in order to tap the supply pressure from a low-pressure source or from a high-pressure source.

LIST OF REFERENCE SYMBOLS

1 drive mechanism
2 working cylinder
4 piston
6 cylinder chamber
8 annular chamber
10 continuously adjustable valve
12 valve assembly
14 releasable non-return valve
16 non-return valve
18 piston rod
20 tank line
22 tank line attenuator
24 biasing valve
26 switching valve
28 supply line
30 branch line
32 supply line
34 control line
36 control line
38 pilot valve

The invention claimed is:

1. A hydraulic drive mechanism for a blanking or forming machine comprising a working cylinder having several pressure chambers, the piston of which acts directly or indirectly on a workpiece to be processed, wherein at least one pressure chamber of the working cylinder for retracting and extending the piston is adapted to be subjected to a tank pressure or a supply pressure via a continuously adjustable valve, and comprising a valve assembly arranged upstream of the continuously adjustable valve, whereby an inlet port (E) of the continuously adjustable valve may be subjected to a higher or lower supply pressure, wherein the valve assembly comprises a switching valve adapted to be switched over between a basic position and a switching position in dependence on the load pressure at the working cylinder, and wherein, in the basic position, the switching valve connects an inlet port of the continuously adjustable valve with the low-pressure source (ND), and, in the switching position, the switching valve blocks the connection to the low-pressure source and connects the inlet port with the high-pressure source (HD).

2. The hydraulic drive mechanism in accordance with claim 1, wherein the working cylinder comprises an annular chamber acting in the retracting direction and a cylinder chamber acting in the extending direction, and wherein the load pressure acting in the cylinder chamber acts on a large control surface of the switching valve.

3. The hydraulic drive mechanism in accordance with claim 2, wherein the large control surface acts in the direction of the switching position of the switching valve, and wherein a small control surface of the switching valve acting in the direction of the basic position of the switching valve is connected with the low-pressure source via a control line.

4. The hydraulic drive mechanism in accordance with claim 3, wherein a pilot valve is arranged in the control line, whereby the small control surface may be subjected to tank pressure for load-independent switching.

5. The hydraulic drive mechanism in accordance with claim 4, wherein the pilot valve is actuated electrically.

6. The hydraulic drive mechanism in accordance with claim 1, wherein the annular chamber is constantly connected to the low-pressure source (ND).

7. The hydraulic drive mechanism in accordance with claim 1, wherein the working cylinder is designed with two or three pressure chambers.

8. The hydraulic drive mechanism in accordance with claim 2, wherein the annular chamber is constantly connected to the low-pressure source (ND).

9. The hydraulic drive mechanism in accordance with claim 3, wherein the annular chamber is constantly connected to the low-pressure source (ND).

10. The hydraulic drive mechanism in accordance with claim 4, wherein the annular chamber is constantly connected to the low-pressure source (ND).

11. The hydraulic drive mechanism in accordance with claim 5, wherein the annular chamber is constantly connected to the low-pressure source (ND).

12. The hydraulic drive mechanism in accordance with claim 2, wherein the working cylinder is designed with two or three pressure chambers.

13. The hydraulic drive mechanism in accordance with claim 3, wherein the working cylinder is designed with two or three pressure chambers.

14. The hydraulic drive mechanism in accordance with claim 4, wherein the working cylinder is designed with two or three pressure chambers.

15. The hydraulic drive mechanism in accordance with claim 5 wherein the working cylinder is designed with two or three pressure chambers.

16. The hydraulic drive mechanism in accordance with claim 6, wherein the working cylinder is designed with two or three pressure chambers.

* * * * *